US005742687A

United States Patent [19]

Aarts

[11] Patent Number: 5,742,687

[45] Date of Patent: Apr. 21, 1998

[54] SIGNAL PROCESSING CIRCUIT INCLUDING A SIGNAL COMBINING CIRCUIT STEREOPHONIC AUDIO REPRODUCTION SYSTEM INCLUDING THE SIGNAL PROCESSING CIRCUIT AND AN AUDIO-VISUAL REPRODUCTION SYSTEM INCLUDING THE STEREOPHONIC AUDIO REPRODUCTION SYSTEM

[75] Inventor: Ronaldus M. Aarts, Eindhoven, Netherlands

[73] Assignee: U.S. Philips Corporation, New York, N.Y.

[21] Appl. No.: 371,187

[22] Filed: Jan. 11, 1995

[30] Foreign Application Priority Data

Jan. 17, 1994 [BE] Belgium ..... 09400048

[51] Int. Cl.[6] ..... H04R 5/00

[52] U.S. Cl. ..... 381/1; 381/17; 381/18; 381/27

[58] Field of Search ..... 381/1, 2, 10, 17, 381/18, 19, 20, 21, 24, 119, 27

[56] References Cited

U.S. PATENT DOCUMENTS

| | | | |
|---|---|---|---|
| 4,308,423 | 12/1981 | Cohen | 179/1 G |
| 4,349,698 | 9/1982 | Iwahara . | |
| 5,165,099 | 11/1992 | Onaya et al. | 381/1 |
| 5,381,482 | 1/1995 | Matsumoto et al. | 381/18 |

FOREIGN PATENT DOCUMENTS

| | | | |
|---|---|---|---|
| 62-232300 | 10/1987 | Japan | 381/27 |

*Primary Examiner*—Curtis Kuntz
*Assistant Examiner*—Duc Nguyen

[57] ABSTRACT

A signal combining circuit has a first input and a second input for receiving signals which have frequencies in the audio frequency spectrum, and an output. A first signal path between the first input and the output has a first transfer characteristic (H1.H3). A second signal path between the second input and the output has a second transfer characteristic (H2.H3). The transfer characteristics are different which causes a phase shift to occur between signal components passed through the first signal path and signal components passed through the second signal path. The amplitude transfer determined by the transfer characteristics decreases above a predetermined frequency. There is a phase difference between phase transfer characteristics which decreases with frequency. For frequencies below the predetermined frequency the amplitude transfer determined by the first transfer characteristic exceeds that determined by the second transfer characteristic. By interconnecting the first input and the second input, the amplitude transfer ((H1+H2).H3) between the interconnected inputs and the output as a function of frequency is substantially constant. The signal combining circuit is used in a stereophonic audio reproduction system to enhance the stereo image. The stereophonic audio reproduction system can form part of an audio-visual reproduction system.

18 Claims, 3 Drawing Sheets

SIGNAL PROCESSING CIRCUIT INCLUDING A SIGNAL COMBINING CIRCUIT STEREOPHONIC AUDIO REPRODUCTION SYSTEM INCLUDING THE SIGNAL PROCESSING CIRCUIT AND AN AUDIO-VISUAL REPRODUCTION SYSTEM INCLUDING THE STEREOPHONIC AUDIO REPRODUCTION SYSTEM

BACKGROUND OF THE INVENTION

This invention relates to a signal combining circuit having a first and a second input for receiving signals which signals have frequencies in the audio frequency spectrum and having an output, the circuit comprising a first signal path which has a first transfer characteristic for passing signal components of the signal received at the first input to the output, and the circuit comprising a second signal path which has a second transfer characteristic for passing signal components received at the second input to the output, the transfer characteristics showing discrepancies which cause a phase shift to occur between signal components passed through the first signal path and signal components passed through the second signal path.

The invention further relates to a signal processing circuit for enhancing a stereo image that corresponds to a stereo audio signal, and in which a signal combining circuit of said type is used. The invention further relates to a stereophonic audio reproduction system that includes a signal processing circuit of said type.

Finally, the invention relates to an audio-visual reproduction system comprising a stereophonic reproduction system of said type.

A signal combining circuit, a signal processing circuit as well as a stereophonic audio reproduction system of said types are known, for example, from U.S. Pat. No. 4,308,423. In that document a stereophonic audio reproduction system is disclosed in which a signal processing circuit is used to enhance the stereo image. This signal processing circuit determines the difference between the left and right channel signals. A delay circuit then delays this difference signal by a period of the order of 0.1 ms. This delayed difference signal is added to or subtracted from the original left channel signal, right channel signal, respectively. The left channel signal thus modified comprises the original left channel signal plus the delayed left channel signal minus the delayed right channel signal. The modified right channel signal comprises the original right channel signal plus the delayed right channel signal minus the delayed left channel signal. On stereo signal reception, the subtraction of the delayed left channel signal from the right channel signal and vice versa results in an enhancement of the stereo image.

When mono signals are received, the left channel signal is equal to the right channel signal. This means that the difference found between the left and right channel signals is equal to zero, which means that the original mono signals are passed on to the loudspeakers. So there is no colouring (frequency-dependent amplitude transfer) of the reproduced mono audio signal. A disadvantage of the known system, however, is that when the stereo signals are processed, tones in the original left (or right) channel signal having a period approximately equal to (n+1)/2 times the delay (where n is a positive integer) no longer occur in the modified left (or right) channel signal. For that matter, the original signal and the delayed signal have opposite phases for these frequencies. A signal having these frequencies, however, does occur in the other modified signal. Worded differently: tones occurring in the left channel and having certain frequencies are reproduced in the right channel and vice versa.

It may happen, for example, that a musical instrument is perceived on the left or on the right side in dependence on the pitch of the sound reproduced by this instrument, which is experienced as annoying by the listener.

It is an object of the invention to provide means by which the stereo image is enhanced without appreciable signal colouring occurring when mono signals are reproduced, and in which there is avoided that a signal travels from the left to the right channel or vice versa.

SUMMARY OF THE INVENTION

According to the invention this object is achieved by a combining circuit as set out in the opening paragraph and which is characterized in that for frequencies below a predetermined frequency the amplitude transfer determined by the first transfer characteristic is greater than the amplitude transfer determined by the second transfer characteristic and in which, when the first and second inputs are interconnected, the amplitude transfer between the interconnected inputs and the output as a function of frequency is substantially constant.

A signal combining circuit according to the invention for enhancement of the stereo image that corresponds to a stereo audio signal that includes both a left and a right channel signal has a left channel input for receiving a left channel signal of a stereo signal, a second input for receiving a right channel signal of a stereo signal, a first and a second signal combining circuit in which the left channel input is connected to the first input of the first signal combining circuit and the second input of the second signal combining circuit, and in which the right channel input is connected to the second input of the first signal combining circuit and the first input of the second signal combining circuit.

In the signal processing circuit according to the invention a filtered right channel signal reduced by the filtered left channel signal is produced on the output of the combining circuits to supply an adapted right channel signal. A filtered left channel signal reduced by a filtered right channel signal is produced on the output of the combining circuit to supply the left channel signal. The signal components on the two outputs which components come from the left channel signal are transmitted through signal paths which have different phase characteristics, so that there is a phase difference between these left channel signal components on the various signal paths. For the signal components on the outputs which components come from the right channel signal there is also a phase difference caused by the different transfer characteristics of the signal paths. These phase differences lead to an enhancement of the stereo image.

As the amplitude transfer on the first signal path exceeds that on the second signal path, it is impossible for a signal to travel from one channel to the other. The transfer characteristics are selected such that the amplitude transfer for mono signals is substantially constant as a function of frequency. In that case there is substantially no colouring of the reproduced mono signals.

An embodiment of the signal combining circuit is characterized in that the circuit includes a signal merging circuit which has a first and a second input and an output, a first filter connected between the first input of the signal combining circuit and the first input of the signal merging circuit, a second filter connected between the second input of the signal combining circuit and the second input of the signal merging circuit and a third filter connected between the output of the signal merging circuit and the output of the signal combining circuit.

Utilization of the third filter is advantageous in that filter operations to be performed on the signals on the two signal paths are performed in the same filter which adds to the simplicity of the circuit.

In the case where the processing circuit according to the invention is used in a stereophonic audio reproduction system that comprises a so-termed subwoofer for reproducing the sum of the very low frequency tones of the left and right channel, the signal meant for the subwoofer can simply be derived from the channel signals after they have been adapted by the processing circuit. For that matter, for the sum of the low frequency tones the amplitude transfer as a function of frequency is constant.

The use of the stereophonic audio reproduction system is highly advantageous for audio-visual reproduction systems. In these audio-visual systems the loudspeakers and the image reproducing screen are generally accommodated in the same cabinet. Due to the limited size of the cabinet the distance between the loudspeakers is small and thus the stereo image is narrow. An enhancement of this stereo image by the signal processing circuit enhances the quality of stereo reproduction considerably.

BRIEF DESCRIPTION OF THE DRAWINGS

The invention will be further explained in the following with reference to the FIGS. 1 to 8 in which.

DESCRIPTION OF THE PREFERRED EMBODIMENTS

Figure 1:
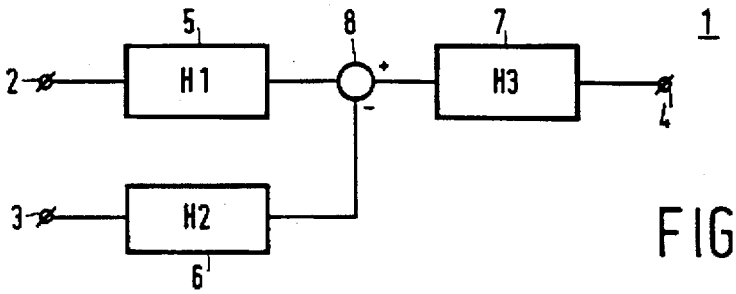
FIG. 1 shows an embodiment for a signal combining circuit according to the invention.

FIG. 1 shows an embodiment of a signal combining circuit 1 according to the invention. The signal combining circuit 1 has a first input 2 and a second input 3 for receiving signals which have frequencies in the audio frequency spectrum (from about 20 Hz to about 20 kHz). The input 2 is coupled via a filter 5 having a transfer characteristic H1 to an input of a signal merging circuit, for example, to a non-inverting input of a subtracter circuit 8. The input 3 is coupled via a filter 6 having a transfer characteristic H2 to an inverting input of the subtracter circuit 8. A difference signal corresponding to the difference found between the signals applied to the inverting and to the non-inverting input is produced at an output of the subtracter circuit 8. In the embodiment shown in FIG. 1 the signal merging circuit is a subtracter circuit. However, other merging circuits such as, for example, adder circuits are also possible. In that case either of the filters 5 and 6 is to perform an additional inverting operation. The difference signal is filtered by a filter 7 having a transfer characteristic H3 and then passed on to the output 4.

Figure 6:
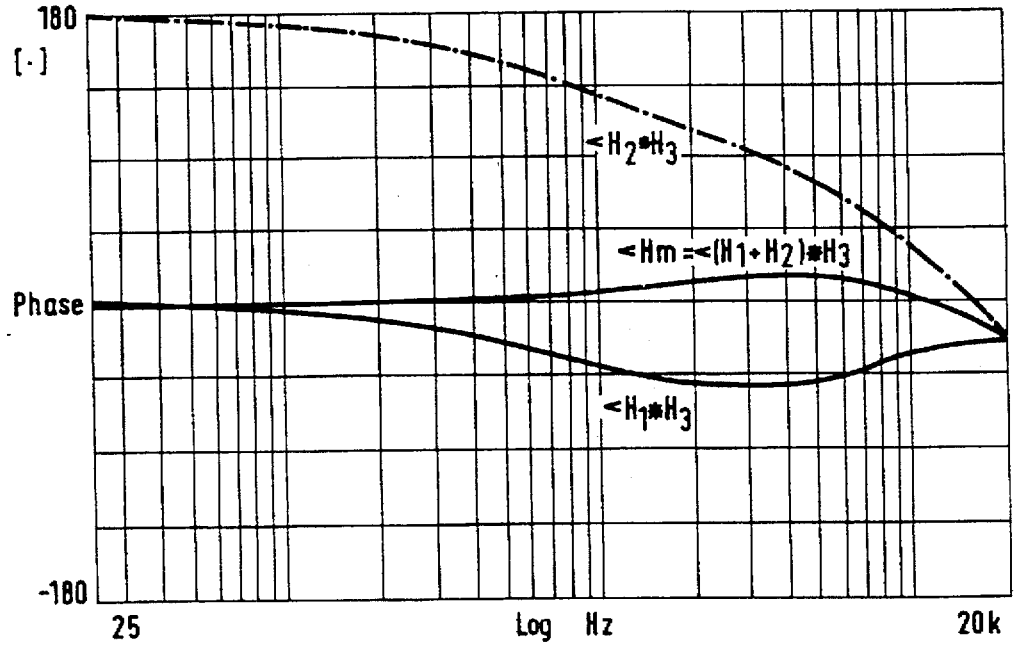
FIG. 6 shows the phase transfer characteristics of different signal paths.

The phase transfer characteristics <H1.H3 and <H2.H3 respectively, from the input 2 to the output 4 and the input 3 to the output 4 are plotted against frequency f in FIG. 6.

The difference between <H1.H3 and <H2.H3 gradually decreases from 180° for low frequencies to zero for high frequencies.

Figure 2:
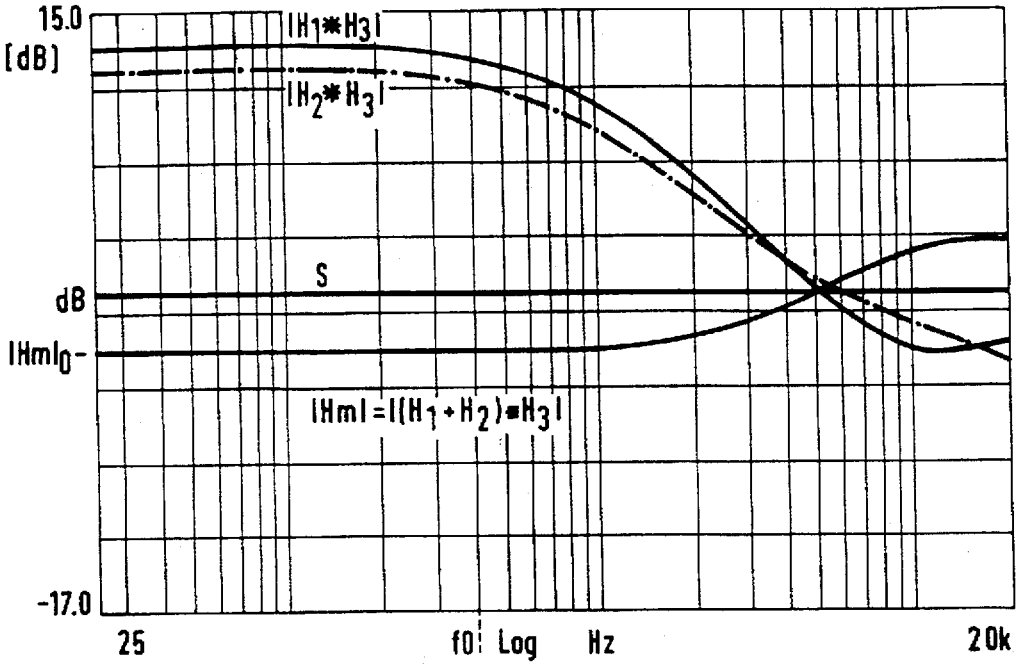
FIG. 2 shows the amplitude transfer characteristic of different signal paths.

The amplitude transfers |H1.H3| and |H2.H3| (expressed in dB's) respectively, from the input 2 to the output 4 and from the input 3 to the output 4 are plotted against frequency f in FIG. 2. Above a predetermined frequency f0 the amplitude transfers |H1.H3| and |H2.H3| diminish. For the case where the inputs 2 and 3 are interconnected, the amplitude transfer |Hm|=|(H1+H2).H3| from the interconnected inputs 2 and 3 to the output of the subtracter circuit 8 is also shown in FIG. 2. The amplitude transfer |Hm| is substantially flat for the whole audio frequency range. For the case where the inputs 2 and 3 are interconnected, the phase transfer <Hm=<(H1+H2).H3 is also shown in FIG. 6. The phase transfer characteristic <Hm is substantially flat throughout the audio frequency range.

The transfer characteristic of the signal path between the input 2 and the output 4 is equal to the product of the transfer characteristics H1 and H3. The transfer characteristic of the signal path between the input 3 and the output 4 is equal to the product of the transfer characteristics H2 and H3.

It will be evident to those skilled in the art that in the case where a filter having the transfer characteristic of the filter H1 equal to H1.H3 is chosen for filter 5 and a filter having a transfer characteristic equal to H2.H3 is chosen for filter 6, the output of the subtracter circuit 8 can be passed on direct (unfiltered) to the output 4.

Positioning the filter 7 between the output of the subtracter circuit 8 and the output 4, however, is advantageous in that filter operations to be performed on the signals on the signal path between input 2 and output 4 and on the signals on the signal path between input 3 and output 4 are performed in one and the same filter, so that filters 5 and 6 can continue to have a simpler structure.

Figure 3:
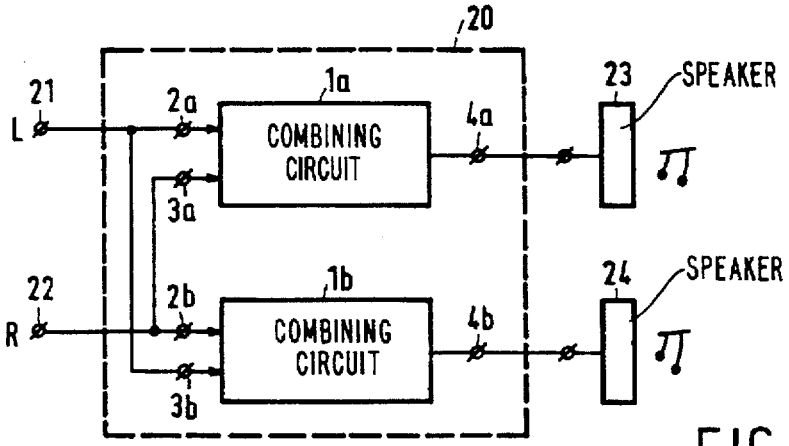
FIGS. 3, 4, 7 and 8 show embodiments for stereophonic audio reproduction systems in which the signal combining circuit is used.

FIG. 3 shows an embodiment for a stereophonic audio reproduction system which includes a signal processing circuit 20 for enhancing a stereo image. The signal processing circuit 20 has a left channel input 21 for receiving a left channel signal L of a stereo audio signal. For receiving a right channel signal R of the stereo audio signal, the processing circuit 20 has a right channel input 22. The signal processing circuit 20 further includes a first signal combining circuit 1*a* and a second signal combining circuit 1*b*. The signal combining circuits 1*a* and 1*b* are both of a type as shown in FIG. 1. The inputs and outputs of the signal combining circuits are referenced by like reference characters shown in FIG. 1, the suffixes a and b denoting which signal combining circuit 1*a* or 1*b* the inputs and outputs belong to. The left channel input 21 is connected to the input 2*a* of the signal combining circuit 1*a* and the input 3*b* of the second signal combining circuit 1*b*. The right channel input 22 is connected to the input 2*b* of the signal combining circuit 1*b* and to the input 3*a* of the signal combining circuit 1*a*.

A left channel loudspeaker 23 is connected to the output 4*a* of the signal combining circuit 1*a*. A right channel loudspeaker 24 is connected to the output 4*b* of the signal combining circuit 1*b*.

The operation of the stereophonic audio reproduction system shown in FIG. 3 is as follows. In the case where a stereo audio signal is supplied, a filtered left channel signal is applied to the left channel loudspeaker. The right channel loudspeaker is then also supplied with a filtered left channel signal whose phase is shifted relative to the filtered left channel signal already applied to the left channel loudspeaker. The right channel loudspeaker is supplied with a filtered right channel signal. The left channel loudspeaker is also supplied with a filtered right channel signal whose phase is shifted relative to the filtered right channel signal applied to the right channel loudspeaker. By the supply of a phase-shifted component of the left channel to the right channel loudspeaker, the position of the sound source that reproduces the left channel will present a virtual shift to the left. Similarly, the source representing the right channel signal will undergo a virtual shift to the right. Worded differently, the stereo image is virtually enhanced. For the frequencies below the frequency f0, the amplitude transfer of the signal path (of the left channel signal L) between the input 2*a* and the output 4*a* is larger than that of the signal path (of the right channel signal R) between the input 3*a* and the output 4*a*, so that components of the left channel signal L are dominantly present for these frequencies. Even in the greater part of the spectrum above this frequency f0 the amplitude transfer by the signal path between the input 2*a* and the output 4*a* exceeds the transfer by the signal path between inputs 3*a* and 4*a*. Thus the audio information intended for the left channel is largely supplied to the left channel loudspeaker 23. The left channel signal is supplied to the left channel loudspeaker 23 by the signal path between the input 2*a* and the output 4*a*. The left channel signal L is supplied to the right channel loudspeaker 24 by the signal path between the input 3*b* and the output 4*b*. When mono signals are reproduced (signals in which the left channel signal L and the right channel signal R are equal), the amplitude of the mono signal (L or R) is the same for all frequencies. Worded differently, no colouring of the reproduced signal takes place in mono reproduction.

Figure 4:
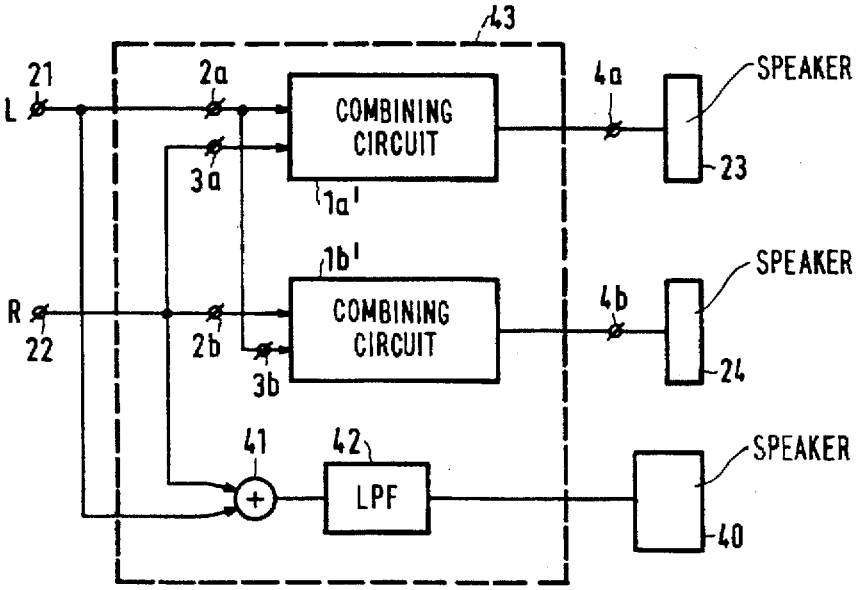

FIG. 4 shows an embodiment for a stereophonic audio reproduction system in which a different embodiment for the signal processing circuit according to the invention is referenced 43. Furthermore, FIG. 4 shows components corresponding to those shown in FIG. 3 which carry like reference characters. Reference character 40 denotes a loudspeaker for reproduction of the very low frequencies, for example, frequencies below 250 Hz. Such a loudspeaker is generally called a subwoofer. The signal for the subwoofer 40 is derived from the left channel signal L on input 21 and the right channel signal R on input 22. For this purpose the system includes a summing circuit 41 for adding together the left channel signal L and the right channel signal R.

An output signal corresponding to the sum of the signals L and R is produced on an output of the summing circuit 41. This signal is applied to a subwoofer 40 via a low-pass filter 42 which passes only signal components having frequencies that are situated in the reproduction spectrum of the subwoofer 40. When the subwoofer 40 is used, the transfer characteristics of the filters 5 and 6 in the combining circuits 1 and 2 can be adapted such that they pass only those signal components that are not applied to the subwoofer 40.

Figure 7:
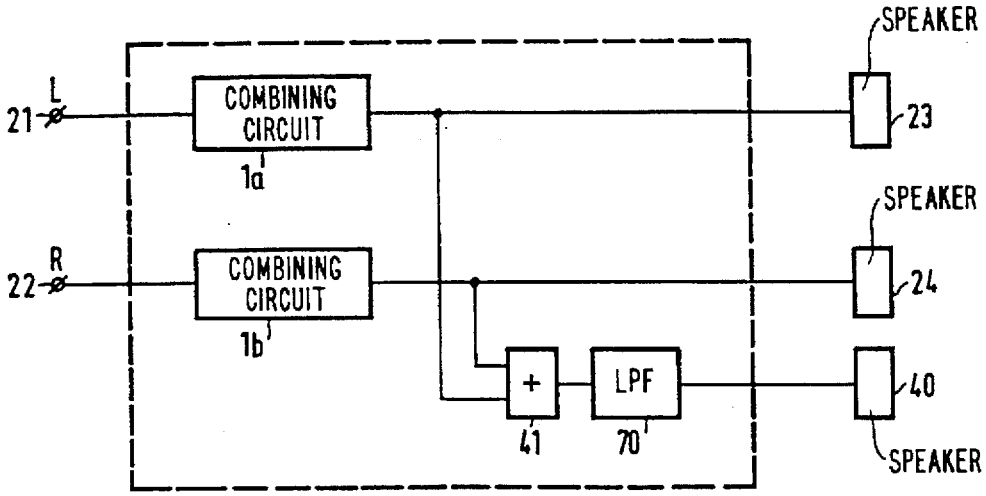

FIG. 7 shows a further embodiment for the stereophonic audio reproduction system according to the invention. Furthermore, the elements which are identical with previously described elements in other embodiments are referenced by like reference characters in FIG. 7.

The inputs of the summing circuit 41 are connected to the outputs of the combining circuits 1*a* and 1*b*. The output signal Sw on the output of the adder circuit is the result of $Sw=L(H1+H2).H3+R(H1+H2)H3=(L+R)Hm$. Since for the subwoofer frequency area Hm is constant as a function of frequency, the signal is substantially equal to the sum of the left channel signal L and the right channel signal R but for a fixed gain factor $|Hm|_0$.

The output signal of the summing circuit 41 is applied to a circuit 70 which has a constant amplitude transfer $1/|Hm|_0$ for the frequencies in the subwoofer frequency area.

Figure 5:
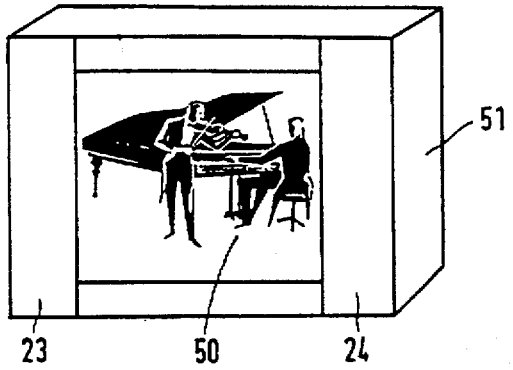
FIG. 5 shows an audio-visual reproduction system.

FIG. 5 shows an embodiment for an audio-visual reproduction system in the form of, for example, a television set or a so-called multimedia audio-visual system. The audio-visual reproduction system comprises a cabinet 51 which accommodates a picture display screen 50 for displaying video pictures. To the left of the picture display screen the left channel loudspeaker 23 is positioned. The right channel loudspeaker 24 is positioned to the right of the picture display screen. The left channel loudspeaker 23 and the right channel loudspeaker 24 are controlled by signal processing circuit 20 or 43 shown in FIGS. 3 or 4.

The use of processing circuits 20 and 43 which have a stereo image enhancement effect in audio-visual reproduction systems is highly attractive. For, due to the limited size of the cabinet, the distance between the loudspeakers is small and, therefore, the stereo image is narrow. An enhancement of the stereo image by the signal processing circuit considerably improves the quality of stereo reproduction.

Figure 8:
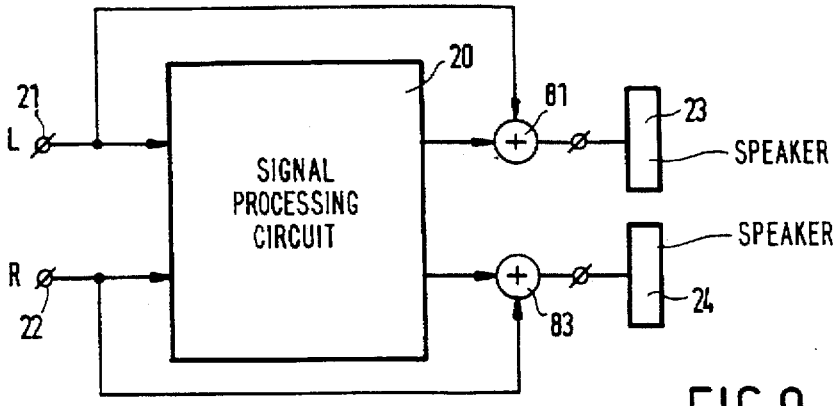

FIG. 8 shows an embodiment for a stereophonic audio reproduction system based on the system of FIG. 3. In addition left and right mixing circuits 81,83 have been added, which enable the adjustment of a mix between the original sound and the processed sound. Each mixing circuit comprises a first and a second mixing input and an output, the first mixing inputs respectively being connected to the left and right channel inputs, and the second mixing inputs respectively being connected to the outputs of the first and second signal combining circuits, in which mixing circuit the transfer function between each input and the output is adjustable. This has the advantage that the strength of the sound processing can be selected. The setting of the mixing circuits 81,83 may be continuously adjustable or switchable between two or more fixed settings. One simple embodiment may comprise a switch for selecting one of the first or second inputs of the mixing circuit. A further embodiment of the mixing circuit may have a transfer of $\alpha$ from the first input to the output and of $1-\alpha$ between the second input and the output, $\alpha$ being a quantity between 0 and 1. This has the advantage, that the total sound level remains constant when the mixing is adjusted by changing $\alpha$. This setting $\alpha$ may be realized by a (logarithmic) potentiometer or by electronic circuitry for volume control. Of course said mixing and setting circuits may process analogue or digital signals.

I claim:

1. A signal combining circuit having a first and a second input for receiving signals which have frequencies in the audio frequency spectrum and having an output, the circuit comprising: a first signal path which has a first transfer characteristic for passing signal components of the signal received at the first input to the output, a second signal path which has a second transfer characteristic for passing signal components received at the second input to the output, the transfer characteristics showing differences which cause a phase shift to occur between signal components passed through the first signal path and signal components passed through the second signal path, wherein for frequencies below a predetermined frequency the amplitude transfer determined by the first transfer characteristic is greater than the amplitude transfer determined by the second transfer characteristic and in which, when the first and second inputs are interconnected, the amplitude transfer between the interconnected inputs and the output as a function of frequency is substantially constant.

2. A signal combining circuit as claimed in claim 1, further comprising a signal merging circuit which has a first and a second input and an output, a first filter connected between the first input of the signal combining circuit and the first input of the signal merging circuit, a second filter connected between the second input of the signal combining circuit and the second input of the signal merging circuit, and a third filter connected between the output of the signal merging circuit and the output of the signal combining circuit.

3. A signal processing circuit for enhancing a stereo image that corresponds to a stereo audio signal, the signal processing circuit comprising: a left channel input for receiving a left channel signal of a stereo signal, a right channel input for receiving a right channel signal of a stereo signal, first and second signal combining circuits each as claimed in claim 1, the left channel input being connected to the first input of the first signal combining circuit and the second input of the second signal combining circuit, the right channel input being connected to the second input of the first signal combining circuit and to the first input of the second signal combining circuit.

4. A signal processing circuit as claimed in claim 3, which circuit further comprises a left and a right mixing circuit each comprising a first and a second mixing input and an output, the first mixing inputs respectively being connected to the left and right channel inputs, and the second mixing inputs respectively being connected to the outputs of the first and second signal combining circuits, and in each mixing circuit the transfer function between each input and the output is adjustable.

5. A signal processing circuit as claimed in claim 4, wherein transfer function of the first mixing input to the output equals $\alpha$ and the transfer function of the second mixing input to the output equals $1-\alpha$, $\alpha$ being a quantity between 0 and 1.

6. A stereophonic audio reproduction system including a signal processing circuit as claimed in claim 3, a left channel loudspeaker connected to the output of the first signal combining circuit of the signal processing circuit, and a right channel loudspeaker connected to the output of the second signal combining circuit of the signal processing circuit.

7. A stereophonic audio reproduction system as claimed in claim 6, further comprising a summing circuit coupled to the outputs of the first and second signal combining circuits for deriving an output signal that corresponds to the sum of components which have frequencies below a predetermined low frequency, which components occur in the signals received at the left and right channel inputs, and a low frequency loudspeaker coupled to an output of the summing circuit and arranged for reproducing frequencies below the predetermined low frequency.

8. Audio-visual reproduction system including a stereophonic audio reproduction system as claimed in claim 6 and a cabinet in which a picture display screen and the left channel and right channel loudspeakers are installed.

9. A signal combining circuit comprising:

first and second input terminals for receiving signals in the audio frequency spectrum, an output terminal for supplying a combination signal, a first signal path which has a first transfer characteristic (H1) for passing signal components of the signal received at the first input terminal to the output terminal, a second signal path which has a second different transfer characteristic (H2) for passing signal components received at the second input terminal to the output terminal, and wherein the different transfer characteristics of the first and second signal paths produce a phase shift between signal frequency components passing through the first and second signal paths and, for frequency components below a predetermined frequency, the amplitude transfer determined by the first transfer characteristic is greater than the amplitude transfer determined by the second transfer characteristic and, when the first and second input terminals are interconnected, the amplitude transfer between the interconnected input terminals and the output terminals, as a function of frequency, is substantially constant.

10. The signal combining circuit as claimed in claim 9 further comprising:

a signal combination circuit having first and second inputs and an output, and wherein the first signal path includes a first filter having the first transfer characteristic (H1) and coupled between the first input terminal and the first input of the signal combination circuit, the second signal path includes a second filter having the second transfer characteristic (H2) and coupled between the second input terminal and the second input of the signal combination circuit, and a third filter having a third transfer characteristic (H3) and coupled between the output of the signal combination circuit and said output terminal.

11. The signal combining circuit as claimed in claim 10 wherein the signal combination circuit comprises a subtraction circuit which produces at its output a difference signal corresponding to a difference between the signals applied to its first and second inputs.

12. The signal combining circuit as claimed in claim 10 wherein the third filter is common to the first and second signal paths which thereby have first and second phase transfer characteristics H1.H3 and H2.H3, respectively, wherein the phase difference therebetween decreases from 180° for low frequencies to zero for high frequencies in the audio frequency spectrum.

13. The signal combining circuit as claimed in claim 9 wherein the first and second signal paths are each adapted to produce an amplitude transfer characteristic that decreases for increasing frequencies above said predetermined frequency.

14. A signal processing circuit for enhancing a stereo image that corresponds to a stereo audio signal, the signal processing circuit comprising:

a left channel input for receiving a left channel signal of a stereo signal, a right channel input for receiving a right channel signal of a stereo signal, first and second signal combining circuits each as claimed in claim 9, the left channel input being connected to the first input of the first signal combining circuit and to the second input of the second signal combining circuit, the right channel input being connected to the second input of the first signal combining circuit and to the first input of the second signal combining circuit, and means for coupling the respective outputs of the first and second signal combining circuits to respective first and second loudspeakers.

15. The signal processing circuit as claimed in claim 14 wherein the first and second signal paths of at least one of said signal combining circuits have different phase characteristics so as to produce a phase difference between signal frequency components passing therethrough and of a value that will enhance the stereo image.

16. The signal processing circuit as claimed in claim 14 further comprising a left and a right mixing circuit each comprising a first and a second mixing input and an output, the first mixing input respectively being connected to the left and right channel inputs, and the second mixing inputs respectively being connected to the respective outputs of the first and second signal combining circuits, and wherein the transfer function of each mixing circuit is adjustable.

17. The signal processing circuit as claimed in claim 16 wherein the transfer function of the first mixing input to the output equals $\alpha$ and the transfer function of the second mixing input to the output equals $1-\alpha$,$\alpha$ a being a quantity between 0 and 1.

18. The signal processing circuit as claimed in claim 14 further comprising:

a summing circuit coupled to the outputs of the first and second signal combining circuits for deriving an output signal that corresponds to the sum of components received from the first and second signal combining circuits, and a low pass filter coupled between an output of the summing circuit and a further output terminal of the signal processing circuit.

* * * * *